US006126460A

United States Patent [19]

Wu

[11] Patent Number: 6,126,460

[45] Date of Patent: Oct. 3, 2000

[54] SAFETY DUAL PLUG STRUCTURE

[75] Inventor: Michael Wu, Hsin Tien, Taiwan

[73] Assignee: Formosa Electronic Industries Inc., Taipei Hsien, Taiwan

[21] Appl. No.: 09/363,889

[22] Filed: Jul. 30, 1999

[51] Int. Cl.[7] ..... H01R 13/44; H01R 13/60

[52] U.S. Cl. ..... 439/131; 439/172; 439/640; 439/956

[58] Field of Search ..... 439/638, 131, 439/171, 172, 173, 174, 956, 640

[56] References Cited

U.S. PATENT DOCUMENTS 4,997,381 3/1991 Oh ..... 439/172
5,967,807 10/1999 Wu ..... 439/131

*Primary Examiner*—Neil Abrams
*Assistant Examiner*—Hae Moon Hyeon
*Attorney, Agent, or Firm*—Dougherty & Troxell

[57] ABSTRACT

A safety dual plug structure with a primary plug and a secondary plug mounted to an electrical charger is disclosed. The primary plug is provided with a casing rotatably received in a cavity defined in the charger with two prongs mounted thereto for selectively engaging with a first type wall outlet. The primary plug has first terminal members connected to the prongs and extending beyond the casing for selectively engaging with first contacts of the charger. An interior space is defined in the casing for movably receiving a secondary plug. The secondary plug has two blades selectively extend beyond the casing of the primary plug for engaging with a second type wall outlet. The secondary plug has second terminal members shielded in the casing of the primary plug. Openings are formed on the casing of the primary plug for allowing second, resilient contacts of the charger to extend into the casing and electrically engage the second terminal members when the secondary plug is in use. Raised portions are formed on the casing for contacting and preventing the second contacts from entering the casing when the secondary plug is not in use thereby eliminating undesired engagement between the secondary plug and the second contacts of the charger.

4 Claims, 11 Drawing Sheets

SAFETY DUAL PLUG STRUCTURE

BACKGROUND OF THE INVENTION

1. Field of the Invention

The present invention generally relates to an electrical plug, and in particular to a safety dual plug structure comprising primary and secondary plugs that can be selectively used.

2. Description of the Prior Art

Electrical appliances powered by built-in rechargeable cells are commonly used. The electrical appliance with built-in rechargeable cells is usually provided with a plug with/without an electrical cord for selectively connection with an electrical receptacle, such as a wall outlet of an electrical main, to charge the cells. The electrical receptacle is generally different from country to country. A conventional plug is generally designed for a receptacle of a particular country and may not be adapted in a different country. To address such a problem, adapters or chargers with a dual plug structure are available in the market and comprise two different plugs to be selectively used in compliance with the different receptacles adapted in different countries or areas.

FIG. 1 of the attached drawings shows a charging adapter 1 having a conventional dual plug structure. The adapter 1 comprises a plug 12 mounted to a first side thereof and adapted to be inserted into a cigarette lighter of a car (not shown) for receiving electricity therefrom and a recess 11 defined in an opposite second side thereof for accommodating the dual plug. The dual plug comprises a primary plug 2 received in the recess 11 and having a pair of prongs 2*a*, 2*b*. An interior space is defined in the primary plug 2 for receiving a secondary plug 3 having a pair of blades 3*a*, 3*b* movably received in slots 21*a*, 21*b* defined in the primary plug 2 in communication with the interior space thereof.

Both the secondary plug 3 and the primary plug 2 are selectively movable between an extended position for engaging with a wall outlet (not shown) and a collapsed position. When the primary plug 2 is moved to the extended position thereof, the secondary plug 3 is moved therewith thereby projecting beyond the housing of the adapter. Inadvertent contact of the blades 3*a*, 3*b* by a user attempting to plug the prongs 2*a*, 2*b* into a wall outlet may occur causing electrical shock to the user.

It is thus desirable to have a dual plug structure that eliminates the problem discussed above.

SUMMARY OF THE INVENTION

Accordingly, an object of the present invention is to provide a dual plug structure comprising safety means for reducing risk of electrical shock of a user.

Another object of the present invention is to provide a dual plug structure comprising a secondary plug movably received in a primary plug and biased by springs to extend beyond the primary plug.

A further object of the present invention is to provide a dual plug comprising a primary plug and a secondary plug of which one has modifiable blades for matching different wall outlet configurations.

To achieve the above objects, in accordance with the present invention, there is provided a dual plug structure adapted to be mounted to an electrical charger for selectively plugging into different wall outlets to supply electrical power to charge a mobile phone. The dual plug structure comprises a primary plug having a casing rotatably received in a cavity defined in the charger with two prongs mounted thereto for selectively engaging with a first type wall outlet. The primary plug comprises first terminal members connected to the prongs and extending beyond the casing for selectively engaging with first contacts of the charger. An interior space is defined in the casing for movably receiving a secondary plug. The secondary plug is spring-biased to have blades thereof selectively extend beyond the casing of the primary plug for engaging with a second type wall outlet. The secondary plug comprises second terminal members shielded in the casing of the primary plug. Openings are formed on the casing of the primary plug for allowing second, resilient contacts of the charger to extend into the casing and electrically engage the second terminal members when the secondary plug is in use. Raised portions are formed on the casing for contacting and preventing the second contacts from entering the casing when the secondary plug is not in use thereby eliminating undesired engagement between the secondary plug and the second contacts of the charger.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figure 1:
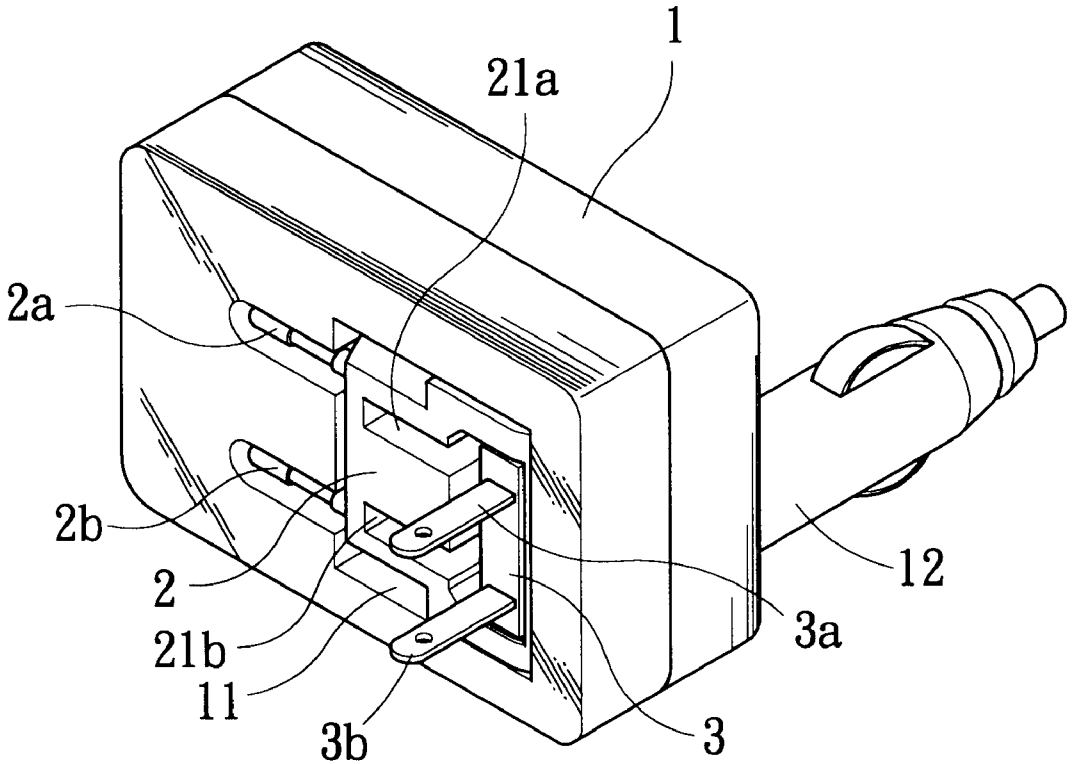
FIG. 1(PRIOR ART)
FIG. 1 is a perspective view of an electrical charger to which a conventional dual plug structure is mounted.
Figure 2:
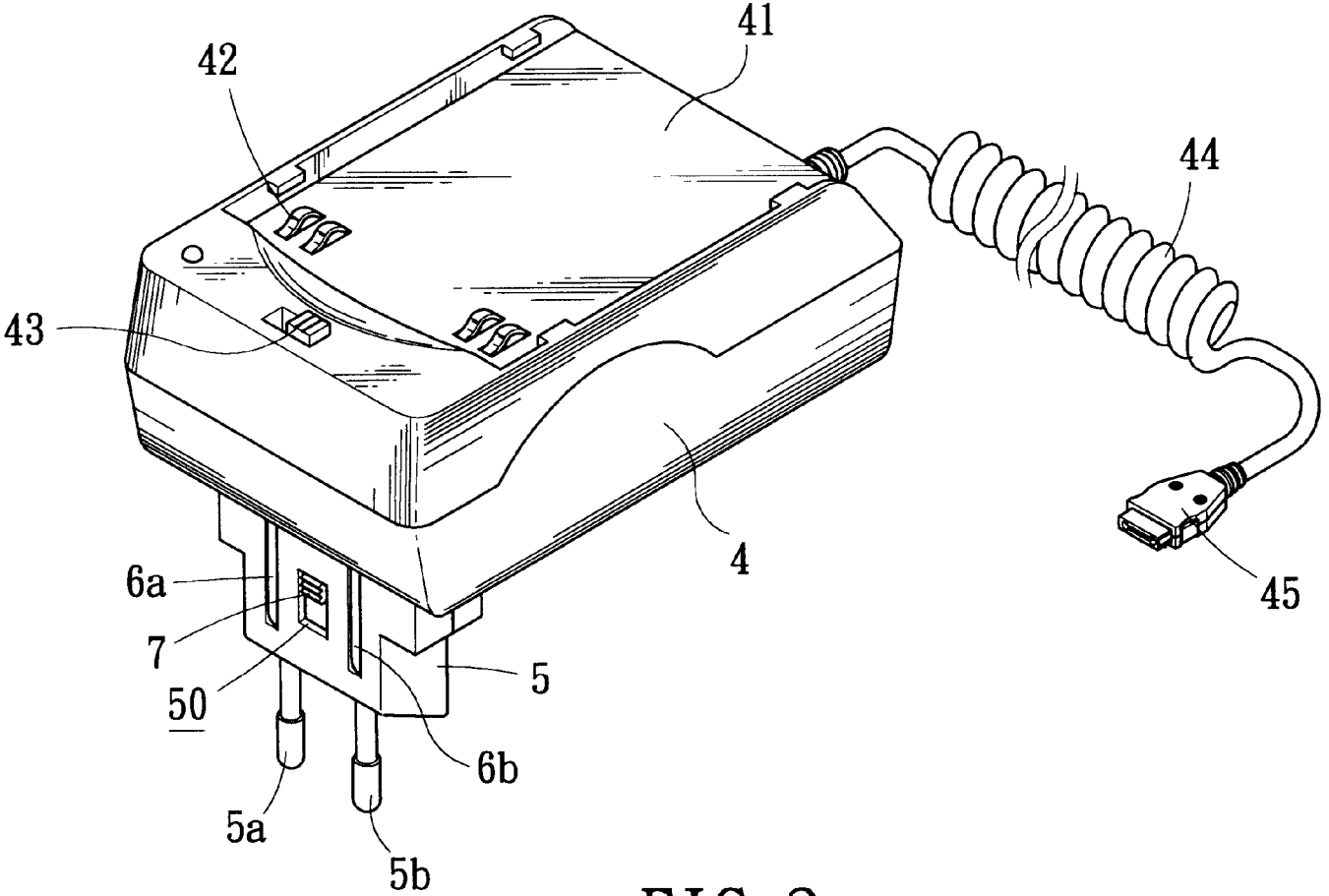
FIG. 2 is a perspective view of an electrical charger to which a dual plug structure in accordance with the present invention is mounted, a primary plug of the dual plug structure being at an erect position and a secondary plug being at a collapsed position.
Figure 3:
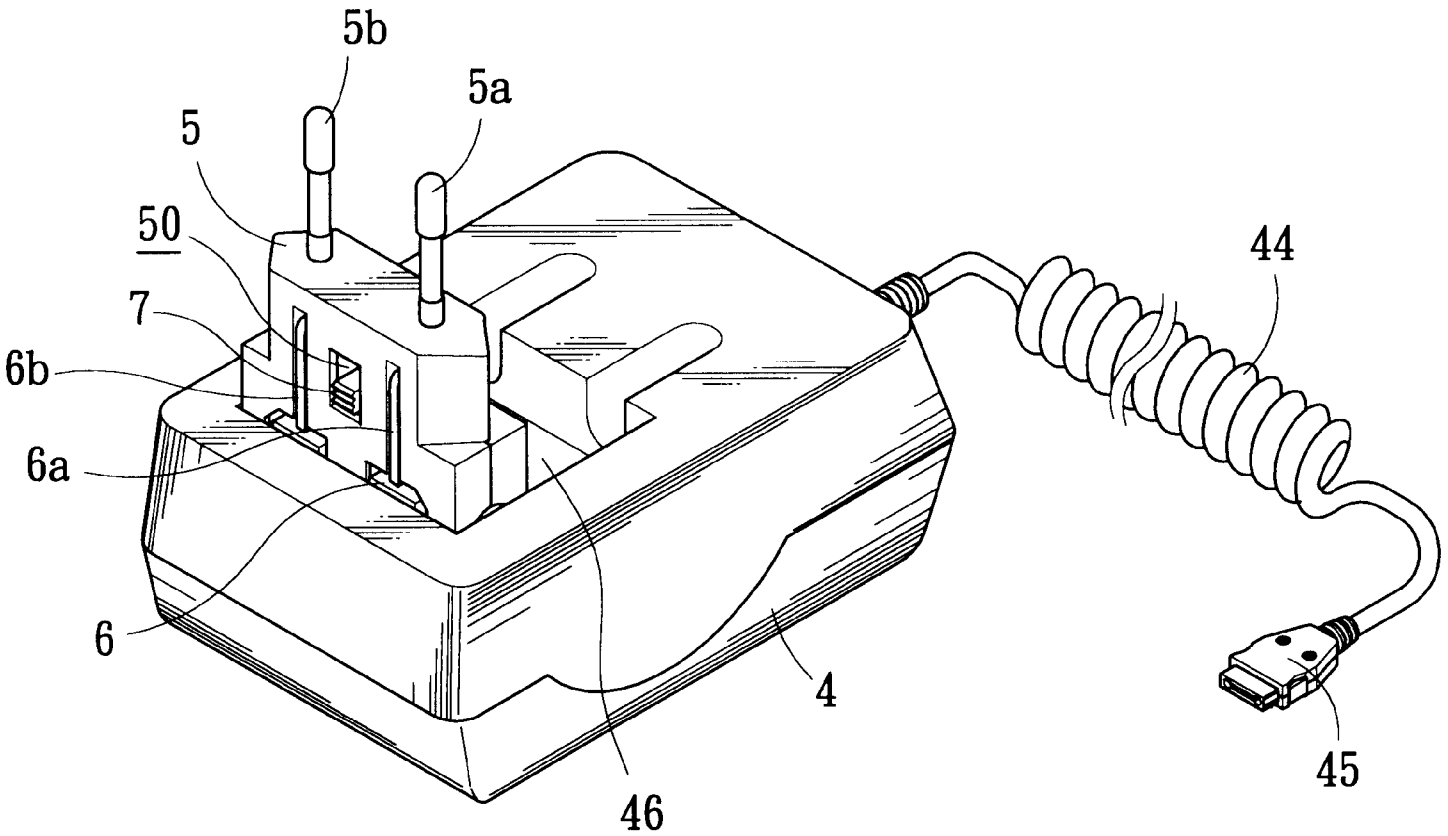
FIG. 3 is similar to FIG. 2 but taken in a different perspective.
Figure 4:
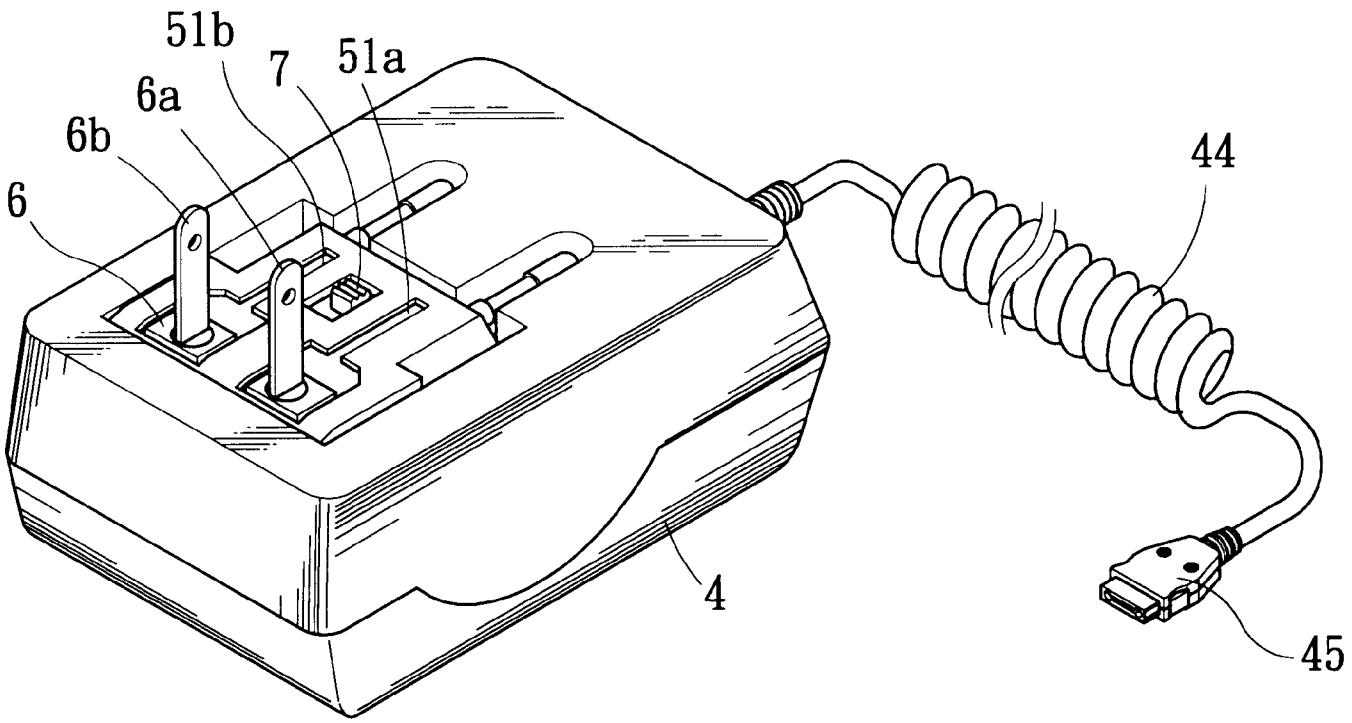
FIG. 4 is similar to FIG. 3 but showing the primary plug at a collapsed position and the secondary plug at an erect position, blades of the secondary plug being arranged to be parallel to each other.

Referring to FIG. 2, a dual plug structure in accordance with the present invention is shown mounted in an electrical charger 4. The electrical charger 4 forms a battery receptacle 41 on a top face thereof for receiving and retaining a rechargeable battery set (not shown). Conductive contacts 42 electrically connected to a circuit board 8 (FIGS. 6, 7, 10 and 11) comprising a control circuit encased in the electrical charger 4 are arranged in the receptacle 41 for electrically engaging with contacts of the battery set for charging purposes. A voltage selection switch 43 in connection with the circuit of the circuit board 8 is provided for user's selection of the voltage level applied to the circuit board 8. A cable 44 connected to the circuit board 8 extends beyond the charger 4 with a plug connector 45 formed on a free end thereof for selectively engaging with a corresponding socket defined in an electrical device, such as a mobile phone.

Also referring to FIGS. 3–6, a cavity 46 is formed on a bottom face of the electrical charger 4 for accommodating the dual plug structure of the present invention. The dual plug structure of the present invention comprises a primary plug 5 and a secondary plug 6. Two pairs of resilient contacts 81*a*, 81*b*, 82*a*, 82*b* are mounted on and electrically connected to the circuit board 8 and extend into the cavity 46. Aligned holes 47 are defined in opposite inside faces of the cavity 46.

Figure 10:
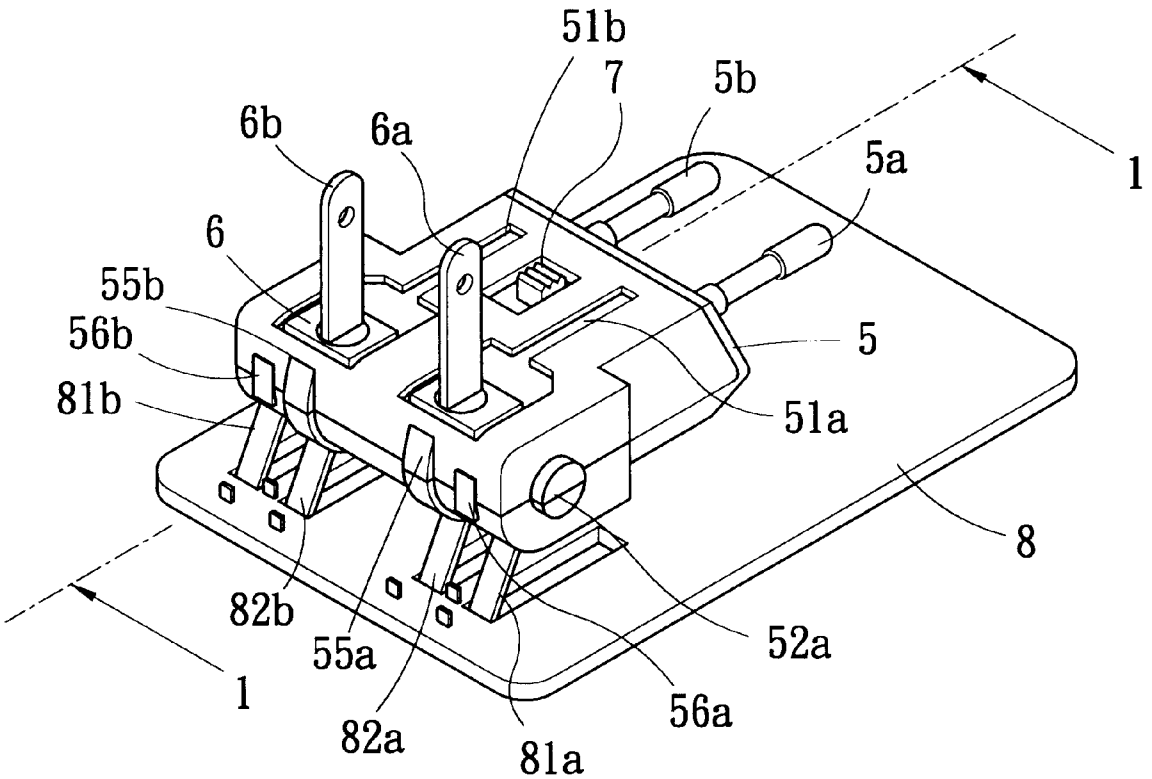
FIG. 10 is a perspective view corresponding to FIG. 4 and showing the dual plug structure mounted in the circuit board of the electrical charger with the housing of the charger removed.

The primary plug 5 is received in the cavity 46 with trunnions 52*a*, 52*b* thereof pivotally received in the holes 47 whereby the primary plug 5 is movable between an erect position (FIGS. 2 and 3) for engaging with a first receptacle (not shown), such as a wall outlet, and a collapsed position (FIGS. 4 and 5) where the primary plug 5 is completely received in the cavity 46. The primary plug 5 comprises an insulative casing (not labeled) defining an interior space (not labeled) for movably receiving the secondary plug 6. Two prongs 5*a*, 5*b* extend beyond the casing of the primary plug 5 for electrically engaging with the wall outlet. Two first terminal members 56*a*, 56*b* fixed in the casing of the primary plug 5 have first ends engaging with the prongs 5*a*, 5*b* and second ends extending beyond the casing of the primary plug 5 (FIG. 10). The second ends of the first terminal members 56*a*, 56*b* engage with the contacts 81*a*, 81*b* of the electrical charger 4 when the primary plug 5 is at the erect position. In this respect, preferably, the second ends of the first terminal members 56*a*, 56*b* form a flat section over which the contacts 81*a*, 81*b* slide. The resiliency of the contacts 81*a*, 81*b* allows them to be deformed during the sliding motion thereof and exerts forces to the flat sections of the first terminal members 56*a*, 56*b* thereby ensuring proper engagement therebetween.

The secondary plug 6 comprises an insulative casing (not labeled) defines two circular bores 64*a*, 64*b* for receiving two blades 6*a*, 6*b* therein. The blades 6*a*, 6*b* are retained in the bores 64*a*, 64*b* by means of a cover plate 66 and extend beyond the cover plate 66 through holes (not labeled) defined therein. Second terminal members 63*a*, 63*b* extend from the blades 6*a*, 6*b* beyond the casing of the secondary plug 6 in opposite direction (FIG. 11).

The secondary plug 6 is received in the interior space of the primary plug 5 with trunnions 61*a*, 61*b* thereof pivotally received in circular recesses 53, 53 defined in the casing of the primary plug 5 thereby rendering the secondary plug 6 movable with respect to the primary plug 5 between a collapsed position (FIG. 3) where the secondary plug 6 is completely received in the casing of the primary plug 5 and an erect position (FIGS. 4 and 5) where the blades 6*a*, 6*b* project beyond the primary plug 5 through two openings 51*a*, 51*b* defined in the casing of the primary plug 5 for being ready to engage with a second wall outlet (not shown).

Figure 11:
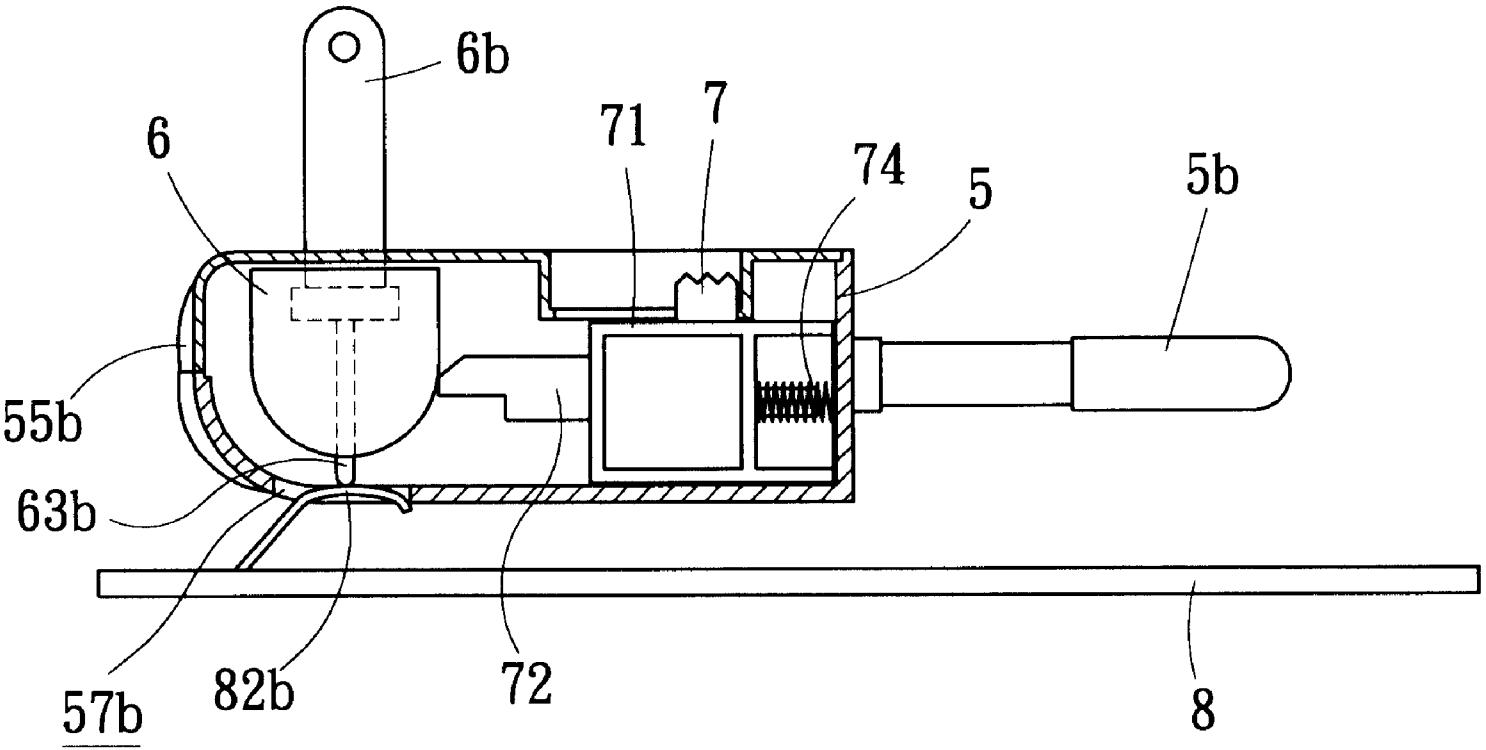
FIG. 11 is a cross-sectional view taken along line 1—1 of FIG. 10.

Openings 57*a*, 57*b* are defined in the casing of the primary plug 5 corresponding to the second terminal members 63*a*, 63*b* of the secondary plug 6 whereby when the secondary plug 6 is moved to the erect position with the primary plug 5 at the collapsed position, the resilient contacts 82*a*, 82*b* extend into the casing of the primary plug 5 through the openings 57*a*, 57*b* by means of the resiliency thereof and get into contact with the second terminal members 63*a*, 63*b* of the secondary plug 6 (FIG. 11).

Two raised ribs 55*a*, 55*b* are formed on the casing of the primary plug 5 and engage the resilient contacts 82*a*, 82*b* of the electrical charger 4 whereby when the primary plug 5 is moved to the erect position, while the secondary plug 6 is at the collapsed position, the ribs 55*a*, 55*b* depress the contacts 82*a*, 82*b* for preventing the contacts 82*a*, 82*b* from extending into the primary plug 5 thereby avoiding undesired electrical engagement between the secondary plug 6 and the contacts 82*a*, 82*b*.

Preferably, each rib 55*a*, 55*b* forms a runway inside the casing of the primary plug 5 for accommodating the movement of the second terminal members 63*a*, 63*b* with respect to the primary plug 5.

Biasing means, such as springs 62*a*, 62*b* are provided between the trunnions 61*a*, 61*b* of the secondary plug 6 and the corresponding recesses 53, 53 of the primary plug 5. The springs 62*a*, 62*b* biases the secondary plug 6 to the erect position thereof. Preferably, each spring 62*a*, 62*b* comprises a resilient wire with a first end thereof retained in a slit (not labeled) defined in an end of the corresponding trunnion 61*a*, 61*b* of the secondary plug 6 and a second end engaging with an inside surface of the corresponding recess 52*a*, 52*b*.

Referring to FIGS. 8–11, a sliding channel 54 is defined in the casing of the primary plug 5 for movably receiving a slide 71. A switch member 7 is fixed to the slide 71 and extends beyond the casing of the primary plug 5 through an opening 50 defined in the casing thereof for facilitating manual movement of the slide 71 between a locking position and a releasing position. A biasing spring 74 is retained between the slide 71 and the casing of the primary plug 5 for biasing the slide 71 toward the locking position. Preferably, the biasing spring 74 is a helical spring having an end fit over a boss 73 formed on the slide 71. A latch pin 72 extends from the slide 71 for engaging with a corresponding bore 65 defined in the casing of the secondary plug 6 when the slide 71 is moved to the locking position.

The latch pin 72 is biased by the spring 74 to engage with the bore 65 of the secondary plug 6 for retaining the secondary plug 6 at the collapsed position. To use the secondary plug 6, the switch member 7 is manually moved against the spring 74 to move the slide 71 to the releasing position for releasing the secondary plug 6 which, under the action of the springs 62*a*, 62*b*, is automatically moved to the erect position.

Figure 5:
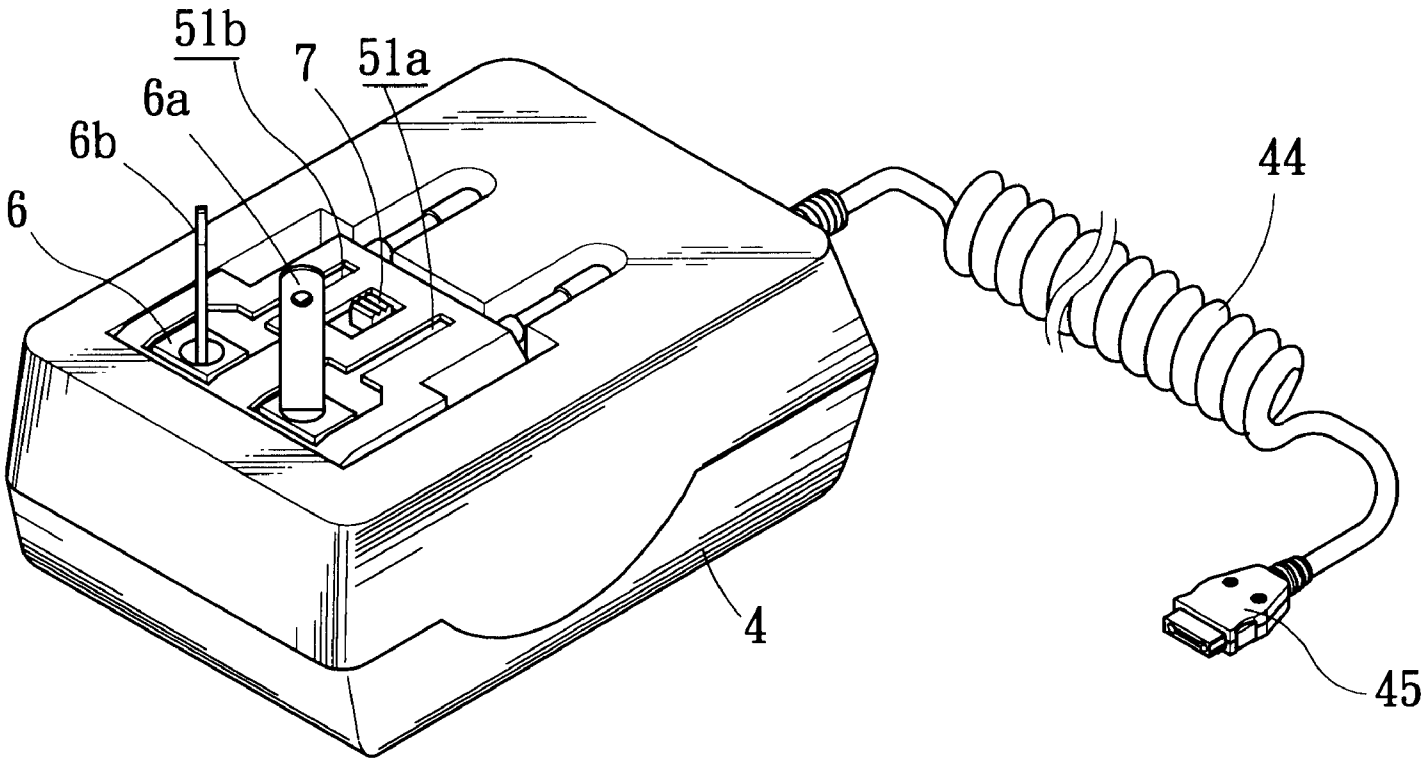
FIG. 5 is similar to FIG. 4 but showing the blades rotated to a predetermined angle toward each other.
Figure 6:
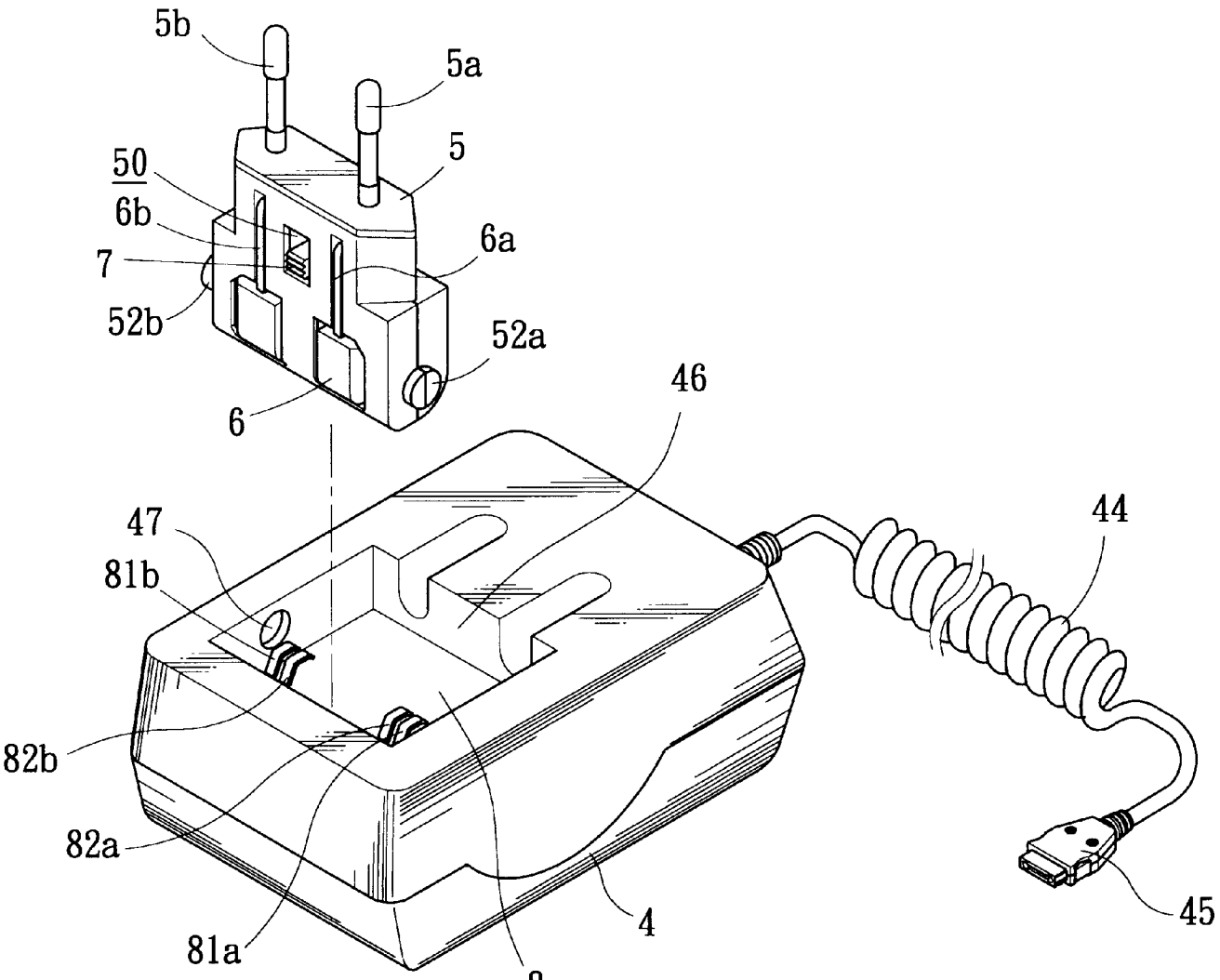
FIG. 6 is a perspective view showing the dual plug structure detached from the electrical charger.
Figure 7:
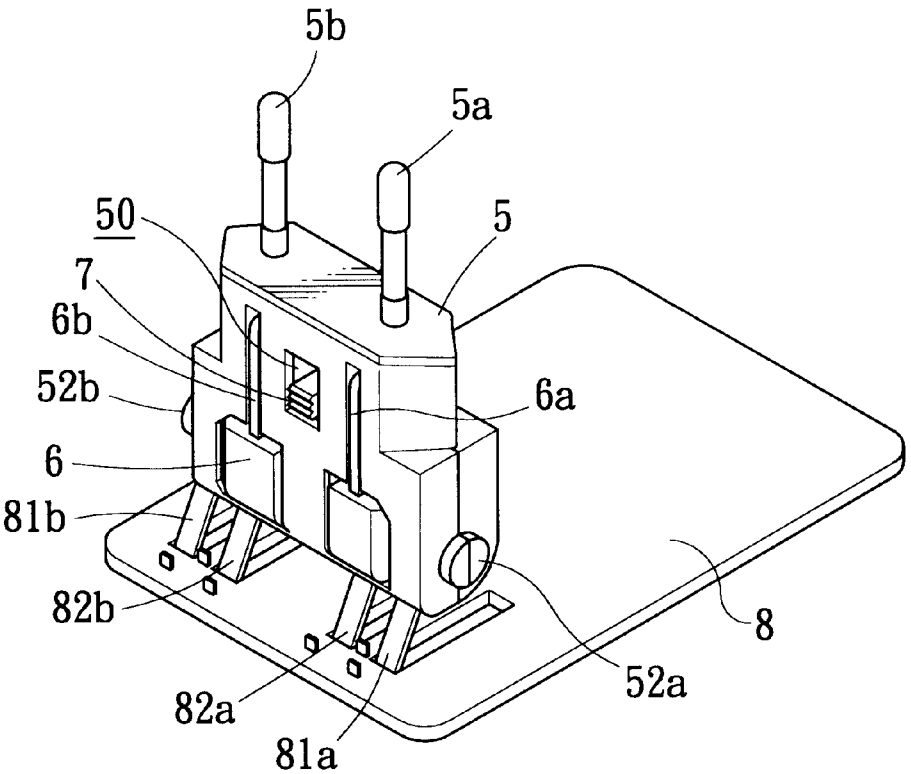
FIG. 7 is a perspective view corresponding to FIG. 3 and showing the dual plug structure mounted in a circuit board of the electrical charger with a housing of the charger removed.
Figure 8:
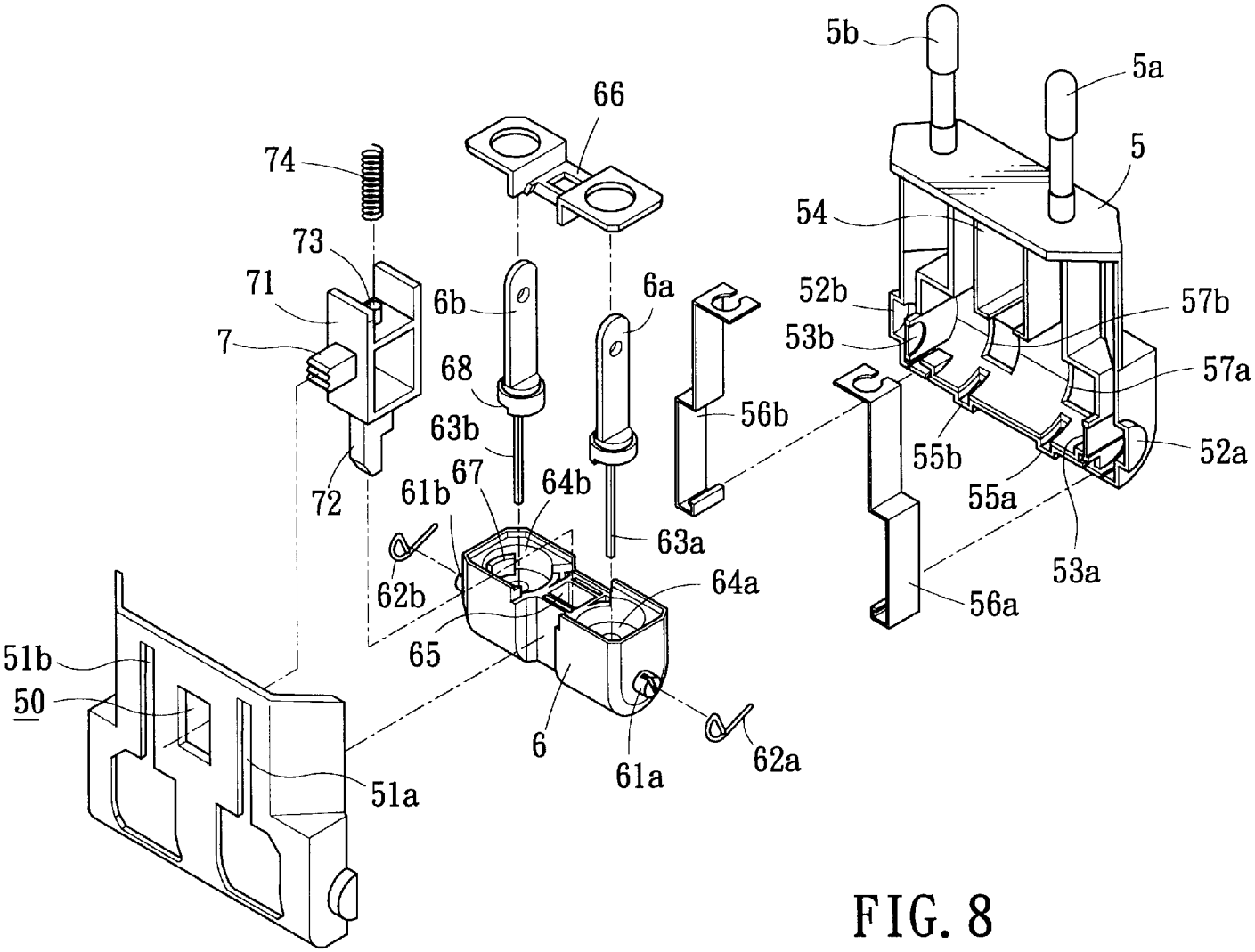
FIG. 8 is an exploded view of the dual plug structure of the present invention.
Figure 9:
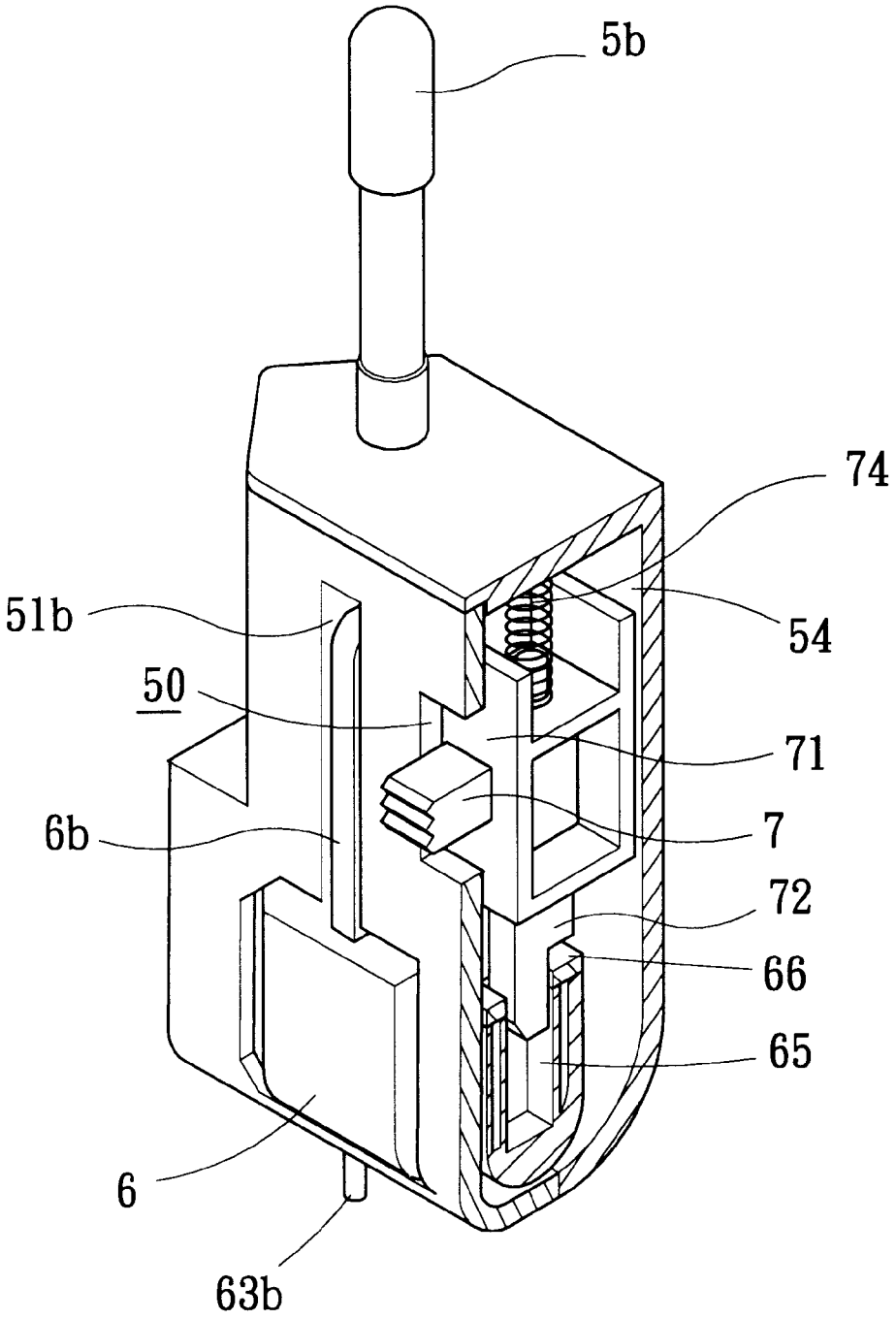
FIG. 9 is a perspective view of the dual plug structure of the present invention with a portion thereof removed for showing inside details.

As shown in FIG. 8, each blade 6*a*, 6*b* of the secondary plug 6 comprises a circular section (not labeled) for rotatably supporting the blade 6*a*, 6*b* in the corresponding bore 64*a*, 64*b* thereby allowing the blade 6*a*, 6*b* to be angularly adjustable and rotatable to different directions for selectively matching receptacles of different configurations (as shown in FIG. 5). The circular section forms a shoulder 68 for engaging with a stop block 67 formed inside the corresponding bore 64*a*, 64*b* for positioning the blade 6*a*, 6*b* at a predetermined angle.

Although the present invention has been described with reference to the preferred embodiment, it is apparent to those skilled in the art that a variety of modifications and changes may be made without departing from the scope of the present invention which is intended to be defined by the appended claims.

What is claimed is:

1. A dual plug structure being mounted in a cavity defined in an electrical device, comprising:

a circuit board arranged in the cavity;

a pair of first contacts and a pair of second contacts being formed on the circuit board;

a primary plug pivotally retained in the cavity and movable between a first erect position where the primary plug partially project beyond the cavity and a first collapsed position where the primary plug is substantially completely received in the cavity, the primary plug comprising:

a first casing defining an interior space, a pair of access openings being formed in the first casing corresponding to the second contacts;

a pair of prongs extending beyond the first casing and being plugged in a first external electrical socket;

a pair of first terminal members fixed in the first casing and having first ends connected to the prongs and second ends extending beyond the first casing; and a pair of raised ribs formed on the first casing and corresponding to and being engageable with the second contacts; and a secondary plug rotatably received in the interior space of the primary plug and movable between a second erect position where the secondary plug partially project beyond the first casing and a second collapsed position where the secondary plug is substantially completely received in the interior space of the primary plug, the secondary plug comprising:

a second casing defining a pair of blade receiving bores, and a pair of blades received and retained in the blade receiving bore and partially extending beyond the second casing and engaging with a second external electrical socket, each blade comprising a second terminal member partially extending beyond the second casing without interfering with the first casing;

whereby when the primary plug is moved to the first erect position, the first terminal members engage with the corresponding first contacts and when the primary plug is moved to the first collapsed position, the first terminal members disengage from the first contact; and whereby when the secondary plug is moved to the second erect position, the second contacts extend into the first casing through the access openings thereof for engaging with the second terminal members of the secondary plug and when the secondary plug is moved to the second collapsed position, the raised ribs engage with and prevent the second contacts from engaging with the second terminal members.

2. The dual plug structure as claimed in claim 1, wherein a sliding channel is defined in the first casing for movably receiving a slide, a switch button formed on the slide and extending beyond the first casing for facilitating manual movement of the slide, and a latch pin extending from the-slide for selectively engaging with a latch receiving bore defined in the second casing thereby retaining the secondary plug at the collapsed position.

3. The dual plug structure as claimed in claim 1, wherein the electrical device comprises a battery receptacle thereon for receiving and retaining a rechargeable battery set.

4. The dual plug structure as claimed in claim 1, wherein an electrical cable is connected to the circuit board and extends from the electrical device, a plug connector being formed on a free end of the cable.

* * * * *